United States Patent [19]

Garofalo

[11] Patent Number: 4,744,165

[45] Date of Patent: May 17, 1988

[54] TRIGGER

[75] Inventor: Giovanni Garofalo, Rapallo, Italy

[73] Assignee: AMF Mares S.p.A., Rapallo, Italy

[21] Appl. No.: 59,849

[22] Filed: Jun. 9, 1987

[30] Foreign Application Priority Data

Jun. 18, 1986 [IT] Italy ..... 15193B/86[U]

[51] Int. Cl.[4] ..... F41C 19/00

[52] U.S. Cl. ..... 42/69.01

[58] Field of Search ..... 42/69.01, 69.02, 69.03; 124/31

[56] References Cited

U.S. PATENT DOCUMENTS

| | | | |
|---|---|---|---|
| 167,285 | 8/1875 | Watkeys | 42/69.01 |
| 4,667,429 | 5/1987 | Perazzi | 42/69.01 |

FOREIGN PATENT DOCUMENTS

| | | | |
|---|---|---|---|
| 2113313 | 3/1971 | Fed. Rep. of Germany . | |
| 2631254 | 7/1976 | Fed. Rep. of Germany . | |
| 1445315 | 5/1966 | France | 42/69.01 |

*Primary Examiner*—Ted L. Parr

*Attorney, Agent, or Firm*—Finnegan, Henderson, Farabow, Garrett and Dunner

[57] ABSTRACT

A portable shooting weapon comprises a releasable firing mechanism and a cooperating trigger and pin for releasing the firing mechanism. The trigger actuates the pin when the trigger is moved by a finger of a shooter. The trigger comprises a first, downwardly extending body portion fulcrumed to the shooting weapon. A second body portion is slidingly supported in the first body portion so that the second body portion is shiftable in a fore and aft direction with respect to the first body portion. The first and second body portions of the trigger are connected together in an easily disengageable manner at a number of pre-set relative positions. The second body portion of the trigger projects beyond the first body portion and the extent of projection is adjustable by disengagement and movement of the second body portion of the trigger with respect to the first body portion.

3 Claims, 2 Drawing Sheets

TRIGGER

BACKGROUND OF THE INVENTION

This invention relates to portable shooting weapons of the type wherein the shooting mechanism is actuated by a trigger, such as, for example, pistols, guns, arbaletes, underwater-fishing guns or the like, and more particularly to the triggers for these weapons.

In this type of weapon, the problem has arisen to adjust or regulate the extent of protrusion of the trigger in order to match the anatomical configuration of each user's hand, for the purpose of obtaining a quicker and swifter response to the shooting command and of obtaining an optimum gripping of the weapon.

DESCRIPTION OF THE PRIOR ART

From German Patent Application No. 2 113 313 filed Mar. 19, 1971 a trigger is known for portable shooting weapons provided with a screw-threaded extension by means of which it may be screwed into a screw-threaded bore selected among a number of similary screwed borings formed in a plate integral with the shooting mechanism of the weapon, so as to adjust the position of the trigger.

The disadvantages of the above known a device are many. At first, it may be said that for each adjusted position of the trigger, the point of application of the force to the shooting mechanism is varied, which is very objectionable. Secondly, it is not so easy to screw and unscrew the trigger each time a different adjustment is requested.

From German Patent Application No. 26 31 254 filed July 12, 1976 a trigger is known for portable shooting weapons which is formed by a substantially L shaped element in which the longer leg of the L acts as the trigger proper, and in which the shorter leg of the L is secured by means of a screw to the shooting mechanism of the weapon. By unscrewing said screw it is possible to pivot the trigger around the screw axis to a different adjustment position.

The main disadvantage of such a prior art trigger resides in the fact the the trigger cannot be anatomically shaped. Again, also with such a trigger it is difficult to achieve the desired adjustment position.

SUMMARY OF THE INVENTION

The object of this invention, therefore, is to provide an improved trigger for shooting weapons, provided with means for regulating i.e. adjusting, into two or more different positions, the protruding extent of the trigger portion designed to contact the user's finger-phalanx, which obviates to all the disadvantages of the known prior art adjustable triggers.

According to a characteristic of the invention, this object is achieved by constructing the trigger in two discrete and separate portions, namely a first body portion fulcrumed in the usual way to the weapon and operatively connected to the shooting mechanism of the weapon, and a second body portion designed to contact the user's finger-phalanx and provided with means adapted to engage, in an easily disengageable manner, said first body portion of the trigger in such a manner as to permit to regulate the extent of protrusion of said second body portion with respect to said first body portion of the trigger to a position which is selected from at least two, preferably three or more, different regulation positions.

Further objects and advantages of the invention will become apparent from the following description of an embodiment thereof, shown merely by way of example in the accompanying drawings, wherein the trigger is shown as applied to the harpoon release mechanism of an underwater-fishing gun.

DESCRIPTION OF THE PREFERRED EMBODIMENT OF THE INVENTION

Figure 1:
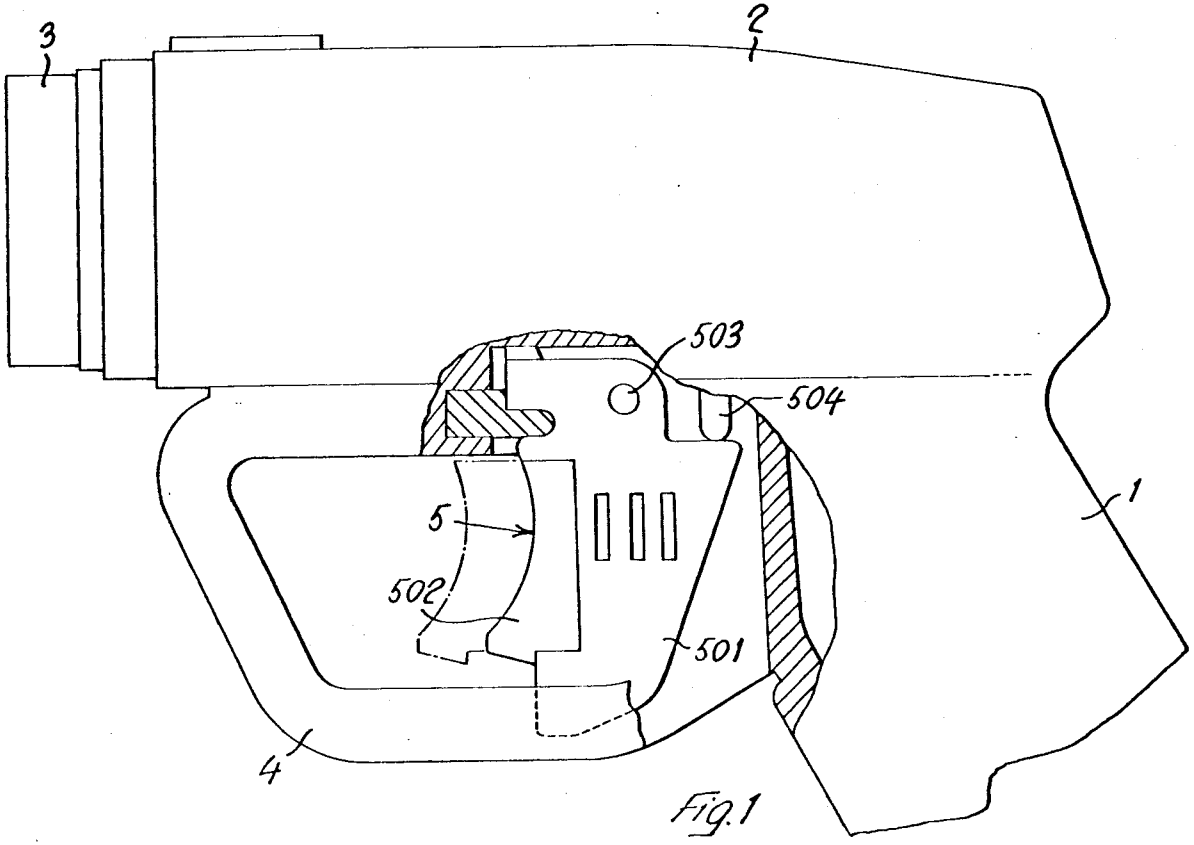
FIG. 1 is a partly sectioned side elevation view of the butt portion of an underwater-fishing gun, provided with a trigger according to the invention.

With reference of the drawings, and more particularly to FIG. 1, the numeral 1 indicates the butt end of an underwater-fishing gun. The butt end 1 is connected to the breech 2 of the gun, which accommodates the hooking mechanism for the harpoon (not shown), and said breech 2 extends forward to merge with the barrel 3. A trigger-guard 4 extends, as usual, between the butt end 1 and the lower side of the breech 2.

The numeral 5 indicates generally the trigger assembly, extending from the breech 2 within the space defined by said trigger-guard 4.

The trigger assembly comprises a body portion 501 and a fore-body portion 502, said portions being adjustable with respect to each other so as to extend the fore-body 502 more or less with respect to the body 501, as described hereinafter.

The body 501 of the trigger is pivoted at 503 to the breech 2 and its rear side comprises a flat or cam-like portion cooperating with a pin 504 which actuates the hooking and releasing mechanism for the harpoon (not shown).

Figure 3:
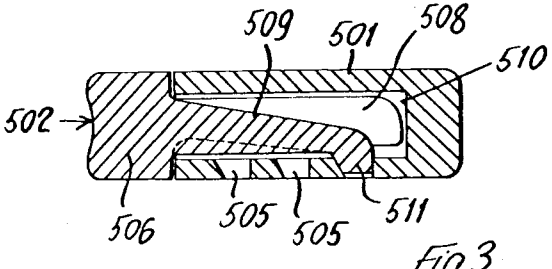
FIGS. 3 and 4 are cross sectional views of the trigger of FIGS. 1 and 2, with the fore body of the trigger being shown in two different adjustment positions.
Figure 4:
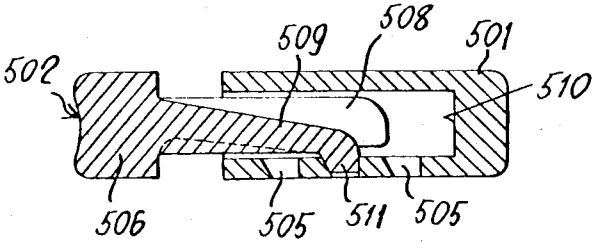

As best shown in FIGS. 3 and 4, the front side of the body 501 is formed with a recess 510, and one sidewall of said body comprises a number (three in the illustrated embodiment) of slots 505 opening into the recess 510 and to the exterior for the purpose to be further discussed below.

Figure 2:
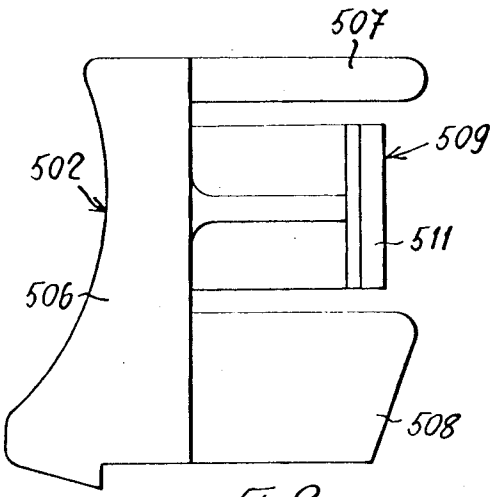
FIG. 2 is a side elevational view of the fore body portion of the trigger shown in FIG. 1.

The fore-body 502 of the trigger comprises, as best shown in FIG. 2, the trigger member proper 506, formed by a member having the same thickness as the trigger body 501 and having an anatomical configuration at its front side. The member 506 comprises three lugs or projections, namely two end lugs 507, 508 and an intermediate lug 509, protruding rearwardly from the member 506. The lugs 507 and 508 are of rectilinear configuration and their thickness and length are substantially equal to the width and depth, respectively, of said recess 510, so as to be slidably received therein.

The intermediate lug 509 has a thickness which is smaller than the width of the recess 510 and is formed with an end portion or tooth 511 protruding sideways to engage one of the slots 505 of said body 501. The lug 509 has a sufficient resiliency to permit the tooth 511 to lockingly snap into one of the soles 505 and thereafter releasingly get out therefrom.

The operation of the device described above will be now apparent.

The rear portion of the fore-body 502 is inserted into the recess 510 of the trigger body 501, and the extent of protrusion of said fore-body is regulated as desired by making the tooth 511 snap into the desired slot 505 of said body 501. This regulation may be changed as desired by acting with a suitable tool on the tooth 511 to urge it inwards until it is disengaged from the slot 505 wherein it is engaged, and thereafter by sliding the fore-body 502 until the tooth 511 snaps into another slot 505 corresponding to the desired extent of protrusion of said fore-body with respect to said trigger body.

Obviously, the present invention is not limited to the embodiment described and illustrated herein, but it comprises all changes and modifications coming within the scope of the appended claims.

I claim:

1. A portable shooting weapon comprising:

a releasable firing mechanism comprising trigger means operable by a finger of a shooter for operating said firing mechanism;

said trigger means comprising a first, downwardly extending body portion fulcrumed to the shooting weapon, wherein the first body portion has a front side with a recess therein;

a second body portion formed at one side with a sliding portion that penetrates said recess in said first body portion; said sliding portion being formed by two or more guiding extensions at least one of which comprises a resilient member provided with a sidewise projection;

and wherein said recess in said first body portion of said trigger means is provided sidewise with two or more slots capable of engagingly receiving said projection so as to releasably lock said second body portion of said trigger means to said first body portion of said trigger means in a selected adjustment position.

2. A trigger according to claim 1, wherein said recess in said first body portion of the said trigger means has a width, and said sliding portion of said second body portion of the trigger comprises:

two end guiding extensions having a thickness complementary to the width of said recess in said first body portion, and an intermediate flexible extension having a thickness smaller than said end guiding extensions, wherein the intermediate flexible extension is provided with a laterally projecting tooth.

3. A trigger according claim 2, in which at least said second body portion of said trigger means and said end guiding extensions are formed integrally of plastic material.

* * * * *